US008739579B2

(12) United States Patent
Son et al.

(10) Patent No.: US 8,739,579 B2
(45) Date of Patent: Jun. 3, 2014

(54) BALL BALANCER AND LAUNDRY APPARATUS HAVING THE SAME

(75) Inventors: Chang Woo Son, Changwon-si (KR); Min Gu Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 846 days.

(21) Appl. No.: 12/461,263

(22) Filed: Aug. 5, 2009

(65) Prior Publication Data

US 2010/0116003 A1 May 13, 2010

(30) Foreign Application Priority Data

Aug. 6, 2008 (KR) ..... 10-2008-0076922

(51) Int. Cl.
*D06F 37/20* (2006.01)
*D06F 29/00* (2006.01)

(52) U.S. Cl.
USPC ..... 68/23.2

(58) Field of Classification Search
USPC ..... 68/23.2, 24; 74/572.4, 570.2
See application file for complete search history.

(56) References Cited

U.S. PATENT DOCUMENTS

| | | | | | |
|---|---|---|---|---|---|
| 4,044,626 | A * | 8/1977 | Hayashi et al. | 68/23.1 |
| 4,433,592 | A * | 2/1984 | Tatsumi et al. | 74/570.2 |
| 4,711,610 | A * | 12/1987 | Riehl | 409/141 |
| 5,806,349 | A * | 9/1998 | Kim et al. | 68/23.2 |
| 6,082,151 | A * | 7/2000 | Wierzba et al. | 68/23.2 |
| 6,219,328 | B1 * | 4/2001 | Kume et al. | 369/269 |
| 6,327,732 | B1 * | 12/2001 | Braunschweig et al. | 8/159 |
| 6,439,003 | B1 * | 8/2002 | Uhlin | 68/23.2 |
| 6,442,782 | B1 * | 9/2002 | Vande Haar | 8/159 |
| 6,741,544 | B1 * | 5/2004 | Naka et al. | 720/702 |
| 6,957,442 | B2 * | 10/2005 | Hong et al. | 720/702 |
| 2004/0172987 | A1 * | 9/2004 | Lim et al. | 68/23.1 |

FOREIGN PATENT DOCUMENTS

CN 1169484 A 1/1998

* cited by examiner

*Primary Examiner* — Joseph L Perrin
(74) *Attorney, Agent, or Firm* — McKenna Long & Aldridge LLP

(57) ABSTRACT

A ball balancer and a laundry apparatus having the same are disclosed. A ball balancer includes a circular housing having motion space formed therein, at least two partition members spaced apart a predetermined distance along the motion space of the housing, the partition members partitioning the motion space into at least two spaces, a plurality of ball members movable within the partitioned spaces of the motion space, and viscous fluid filled in the motion space. Such the ball balancer may reduce noise and vibration of the laundry apparatus having the same.

8 Claims, 6 Drawing Sheets

BALL BALANCER AND LAUNDRY APPARATUS HAVING THE SAME

CROSS REFERENCE TO RELATED APPLICATION

This application claims the benefit of the Patent Korean Application No. 10-2008-0076922, filed on Aug. 6, 2008, which is hereby incorporated by reference as if fully set forth herein.

BACKGROUND OF THE DISCLOSURE

1. Field of the Disclosure

The present invention relates to a ball balancer and a laundry apparatus having the same. More particularly, the present invention relates to a ball balancer capable of reducing noise and vibration of a laundry apparatus and a laundry apparatus having the same.

2. Discussion of the Related Art

Generally, laundry apparatuses are home appliances that are used to remove dirt and foreign substances of clothes, cloth items and the like (hereinafter, laundry) which are put on by users. A laundry apparatus may be a washing machine and a dryer and a single appliance that performs washing and drying operation. Such the laundry apparatus includes an oriented rotatable drum within a cabinet defining an exterior appearance thereof. The drum is rotating and washing or drying operation is performed. The washing operation includes a washing, rinsing and drying-spinning cycle.

However, noise and vibration occur in a conventional laundry apparatus during the rotation of the drum. This would give unpleasant feeling to a user. Especially, in case a laundry apparatus is a washing machine or single appliance capable of performing washing and drying operation, substantially severe vibration and noise would be generated by a drum rotating at a high rotation number in the drying-spinning cycle.

The present invention is invented to solve the above problem and to provide a laundry apparatus able to reduce noise and vibration.

Another object of the present invention is to provide a control method of a laundry apparatus able to reduce noise and vibration in case a drum is rotated at a high rotation number, for example, a drying-spinning cycle.

SUMMARY OF THE DISCLOSURE

Accordingly, the present invention is directed to a ball balancer and a laundry apparatus having the same.

An object of the present invention is to provide a ball balancer able to reduce noise and vibration.

Another object of the present invention is to provide a laundry apparatus able to reduce noise and vibration in case a drum is rotated at a high rotation number, for example, a drying-spinning cycle.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a ball balancer includes a circular housing comprising motion space formed therein; at least two partition members spaced apart a predetermined distance along the motion space of the housing, the partition members partitioning the motion space into at least two spaces; a plurality of ball members movable within the partitioned spaces of the motion space; and viscous fluid filled in the motion space.

The viscous fluid may be able to pass the partition members and the ball members may be unable to pass the partition members.

The partition member may be configured of a rib or boss.

The plurality of the ball members may be distributed in the partitioned spaces of the motion space uniformly.

In another aspect of the present invention, a laundry apparatus includes a drum receiving laundry therein, the drum comprising a plurality of lifters extending inward; a circular housing provided in an outer surface of the drum, the circular housing comprising motion space formed therein; at least two partition members spaced apart a predetermined distance along the motion space of the housing, the at least two partition members alternating with the plurality of the lifters in a semi-circumferential direction, respectively, and partitioning the motion space into at least two spaces; and a plurality of ball members movable within the partitioned spaces of the motion space.

Each of the partition members may be arranged in a center of each adjacent two of the plurality of the lifters.

The laundry apparatus may further include viscous fluid filled in the motion space.

The viscous fluid may be able to pass the partition members may be unable to pass the partition members.

The partition member may be configured of a rib or boss.

The plurality of the ball members may be distributed in the partitioned spaces uniformly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
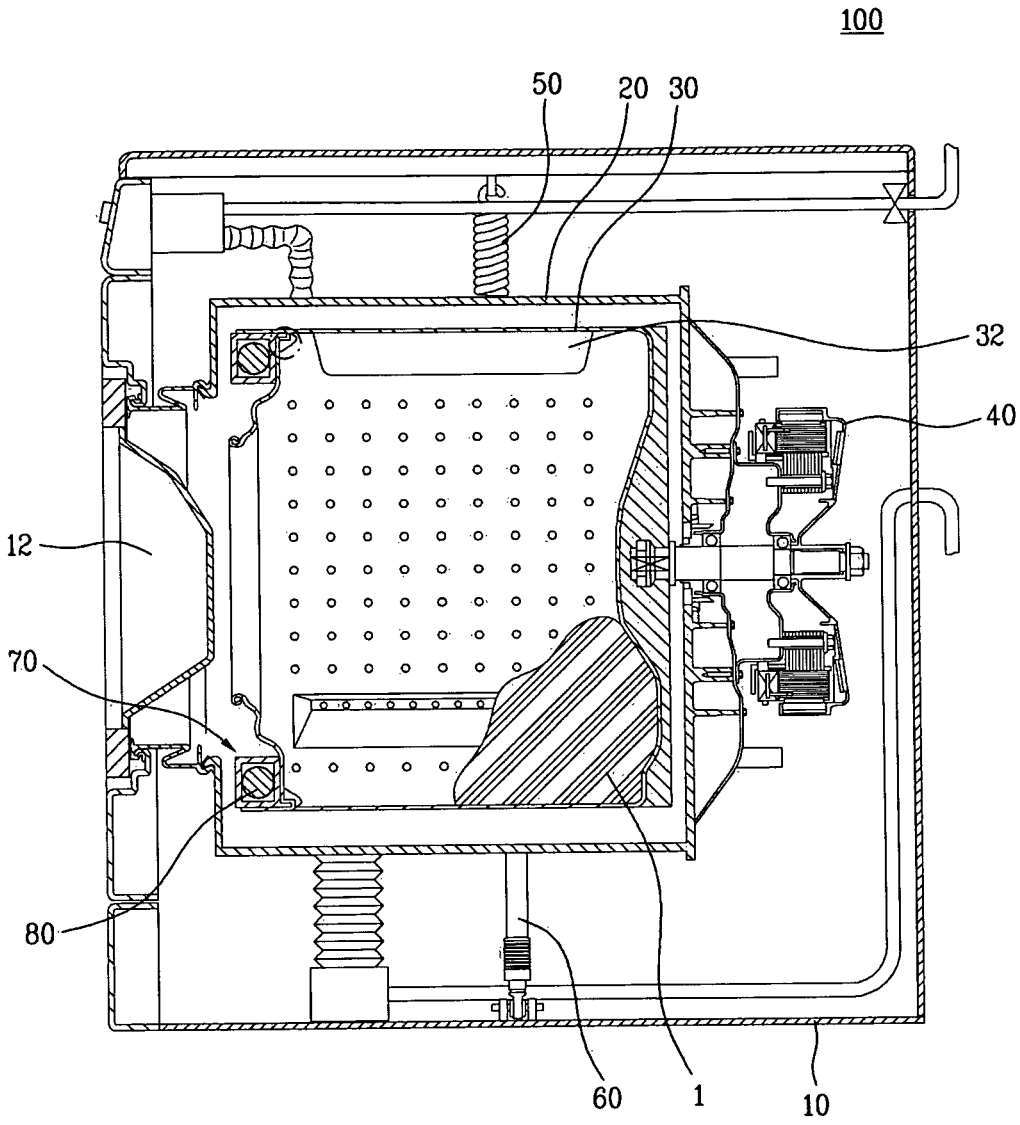
FIG. 1 is a side sectional view illustrating a laundry apparatus according to an exemplary embodiment of the present invention.

FIG. 1 is a side sectional view illustrating an inner configuration of a laundry apparatus according to an exemplary embodiment of the present invention.

In reference to FIG. 1, a laundry apparatus 100 according to this embodiment includes a cabinet 10, a tub 20 and a drum 30. The cabinet 10 defines an exterior appearance of the laundry apparatus. The tub 20 is provided in the cabinet 10 and it receives wash water therein. The drum 20 is rotatable within the tub 20.

In the cabinet 10 defining the exterior appearance of the laundry apparatus 100 according to this embodiment may be provided various components which will be described. A door 12 is coupled to a front of the cabinet 10 and a user will open the door 12 to introduce laundry into the cabinet 10.

The tub 20 receiving wash water is provided in the cabinet 10 and the drum 30 receiving laundry is rotatably provided in the tub 20. Here, a plurality of lifters 32 may be provided in the drum 30. During the rotation of the drum 30, the lifters 30 lift and drop the laundry to improve washing efficiency. Such the lifter 32 may be provided in plural. For example, according to this embodiment, the laundry apparatus 100 includes three lifters 32 provided in the drum 30 and the number of the lifters 32 may be variable, not limited thereto.

The tub 20 is elastically supported by a spring 50 and a damper 60. In case the drum 30 is rotated, vibration of the drum 30 is absorbed by the spring 50 and the damper 60 such that such the vibration may not be transmitted to the cabinet 10. In addition, a driving part 40 rotating the drum 30 is mounted to a rear of the tub 20 and the driving part 40 is configured of a motor to driving the drum 30 selectively. The configuration of such the driving part 40 is well-known in the art which the present invention pertains to and detailed description thereof will be omitted accordingly.

If laundry 1 is received in the drum 30 during the rotation of the drum 30 as shown in FIG. 1, much noise and vibration would be generated according to a position of laundry 1. That is, if the laundry 1 is not distributed inside the drum 30 uniformly, that is, if the drum 30 is eccentrically rotated with the laundry biased in one side, substantially much vibration and noise may be generated in the drum 30 because of the varying distribution of the laundry. To prevent the vibration and noise generated by the eccentric rotation of the drum 30, a ball balancer 70 may be provided in the drum 30.

The ball balancer 70 is provided in the rotating drum 30 and it is preferable that the ball balancer 70 is provided in a front of the drum 30. If the drum 30 is rotated at a high rotation number, for example, in a spinning cycle, the laundry would be collected in one side of the drum 30, that is, an inner rear portion of drum 30 and the ball balancer 70 balances the laundry collected in the rear portion of the drum 30.

Such the ball balancer 70 is mounted to the rotating drum 30 to prevent noise and vibration and it may move variously to compensate the eccentric rotation of the drum 30. That is, the ball balancer 70 includes predetermined material having a predetermined weight and a passage of which the material can move along a circumference. If load is concentrated on a predetermined side of the drum 30, the material provided in the ball balancer 70 moves to an opposite direction to the direction in which load is concentrated such that the noise and vibration generated by the eccentric rotation of the drum 30 may be prevented.

Here, the ball balancer 70 may be a liquid ball balancer having liquid with a predetermined weight or a ball balancer having a ball member with a predetermined weight. The laundry apparatus according to this embodiment presents a ball balancer having a ball member and viscous fluid which will be described as follows.

Figure 2:
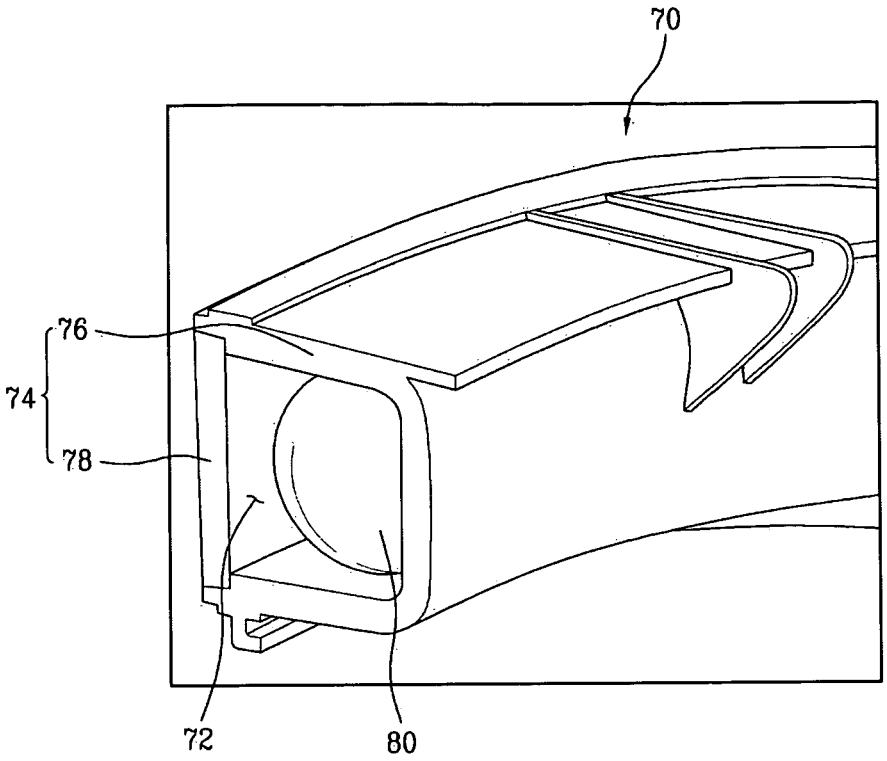
FIG. 2 is a perspective view partially illustrating a ball balancer shown in FIG. 1.

FIG. 2 is a sectional view illustrating the ball balancer 70 provided in the drum shown in FIG. 1.

In reference to FIG. 2, the ball balancer 70 is secured to the drum 30 and it is rotated together with the drum 30 to compensate the eccentric rotation of the drum 30. That is, the ball balancer 70 according to a first embodiment of the present invention is secured to a front of the drum along an outer circumferential surface of the drum 30.

The drum 30 is rotated in a state of being fixed to the driving part 40. As the ball balancer is installed as far from the driving part as possible, a large moment is applied only by the small weight of the ball balancer 70 such that the eccentricity may be compensated. According to this embodiment, the ball balancer 70 is installed in the front surface of the drum to improve the efficiency of the ball balancer 70. Here, the present invention is not limited thereto and it is possible to install the ball balancer in a rear of the drum 30.

The ball balancer 70 may be installed to the drum 30 by a securing member (not shown). generally, it is possible to use a screw member passing the outer circumferential surface of the drum 30 from the front surface of the drum 30 which ends up to be secured to the ball balancer 70. Of course, the present invention is not limited to the above. Rather than the above presentation, the ball balancer 70 may be installed to the drum by another securing way such as a hook.

For example, a flange (not shown) extending forward along the outer circumferential surface of the drum may be formed in the front surface of the drum 30 and a seating groove (not shown) may be formed in the front surface of the drum 30. Then, the ball balancer 70 seated in the seating recess is secured to the drum by the securing member and it is rotated together with the drum 30 when the washing apparatus is put into operation.

As shown in FIG. 2, such the ball balancer 70 may be configured of a circular housing 74 having motion space 72. The housing 74 includes a body 76 having an open side and a cover 78 covering the open side of the body 76. Viscous fluid is injected into the body 76 of the ball balancer 70, together with a ball member 80 which will be descried and the cover 78 is fabricated in the open side of the body 76.

Specifically, the ball balancer 70 includes a ball member 80 that is movable to compensate the eccentric rotation of the drum 30. A plurality of ball members 80 may be provided in the ball balancer 70 and they are movable along the motion space 72 of the ball balancer 70. As the housing 74 is formed circularly as mentioned above, the motion space 72 formed along the inside of the housing 74 may be formed along a passage of the circular shape as well. As a result, the ball member 80 provided in the ball balancer 70 may move along the circular motion space 72 and thus the eccentric rotation of the drum 30 is compensated. If then, the number of the ball members 80 injected into the ball balancer 70 may be 10 to 40, for example, and the number may be variable.

The ball members 80 provided in the ball balancer 70 may compensate the eccentric rotation of the drum 30. However, the ball members 80 would be collided against each other by the rotation of the drum 30 during their motion and this would cause noise. By extension, in case the drum 20 is rotated at the high rotation number, the ball members 80 would be collided against the housing 74 of the ball balancer 70 to result in damage to themselves. As a result, it is preferable that viscous fluid is provided in the ball balancer 70, together with the ball members 80. The viscous fluid may fill in the motion space 72 of the ball balancer 70 to prevent the rapid motion of the ball members 80 such that the noise and damage to the ball balancer 70 may be prevented. Such the viscous fluid may be configured of fluid having a predetermined weight, for example, silicon oil or the like.

The ball balancer 70 having the above configuration may be provided in the front of the drum 30. in case the drum 30 is rotated, especially, at the high rotation speed such as during the spinning cycle, the ball members 80 provided in the ball balancer 70 may move toward an opposite direction to the laundry received in the drum 30 and it may prevent the noise and the vibration caused by the eccentric rotation of the drum 30.

If the motion space 72 is a single space in communication in case of the ball members 80 being moved along the motion space 72 by the rotation of the drum 30, all of the ball members provided in the ball balancer 70 80 would be collected in one side. if all of the ball members 80 are collected in one side during the motion of the ball members 80 along the inside of the ball balancer 70 in case of a relatively large amount of laundry, the ball members and the laundry may be in balance. In case of a relatively small amount of laundry, the noise and vibration of the drum 30 may be accelerated by the ball members 80 collected in one side.

Because of that, according to this embodiment, the ball balancer 70 may include at least two partition members (71, see FIG. 3) formed along the inside of the housing 72 and partitioning the motion space 72 into at least two spaces.

Figure 3:
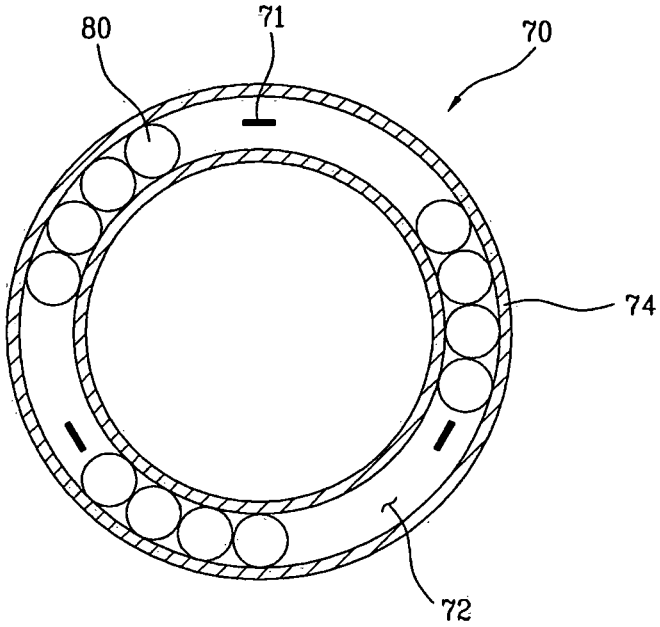
FIG. 3 is a diagram schematically illustrating a configuration of a ball balancer according to a first embodiment of the present invention.

FIG. 3 illustrates a configuration of a ball balancer according to a first embodiment.

In reference to FIG. 3, the partition members 71 are arranged along the motion space 72, spaced apart a predetermined distance from each other, such that the motion space 72 may be partitioned into at least two spaces. According to this embodiment, three partition members 72 are provided and they partition the motion space 72 into threes spaces. The number of the partition members is not limited to three and it may be variable appropriately.

If the partition members partition the motion space 72 into at least two spaces, the ball members 80 provided in the ball balancer 70 may be arranged in the partitioned motion space uniformly. The ball members 80 arranged in the partitioned motion space 72 uniformly may be movable along the partitioned motion space 72 which they have arranged primarily and they may not pass the partition member 71. As a result, the ball members 80 may not be collected in one side within the motion space 72 during the rotation of the drum 30 and the noise and vibration caused by the eccentric rotation of the drum 30 may be prevented efficiently.

Specifically, such the partition members 71 may be provided along the inside of the housing 74 in a circumferential direction of the housing 74. That is, as shown in FIG. 3, the partition members 71 may be ribs having a predetermined length in a circumferential direction of the housing 74. because of the ribs 71 partitioning the motion space 71 into three spaces, the ball members 80 provided in the housing 74 may not move over one of the motion space 72 partitioned by the ribs 71 and the viscous fluid (not shown) filled in the housing 74 may move regardless of the ribs 71.

Thus, during the rotation of the drum 30, the ball members 80 provided in the ball balancer 70 may be movable along the spaces of the motion space 72 partitioned by the partition members 71 and the viscous fluid filled in the ball balancer 70 may be movable regardless of the partition members 71, such that the noise and vibration caused by the eccentric rotation of the drum 30 may be prevented.

Figure 4:
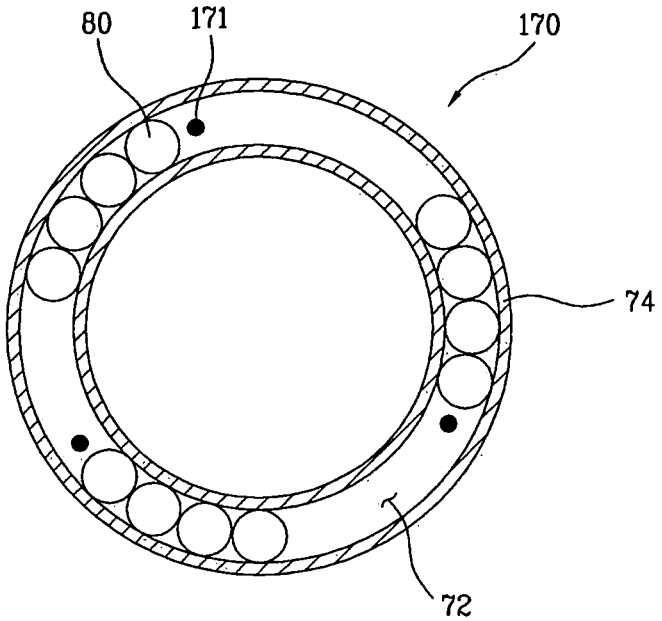
FIG. 4 is a diagram schematically illustrating a configuration of a ball balancer according to a second embodiment of the present invention.

In the meanwhile, FIG. 4 is a diagram schematically illustrating a configuration of a ball balancer 170 according to a second embodiment of the present invention. The ball balancer 170 according to this embodiment of FIG. 4 is different from the ball balancer 70 according to above embodiment of FIG. 3.

Specifically, partition members 171 partitioning the motion space 72 inside the ball balancer 170 may be bosses 171 projected from an inner space of the housing 74. Such the bosses 171 may be formed along a circumferential direction of the housing 74 to limit the motion of the ball members 80, allowing the motion of the viscous fluid.

The ball balancer 70 having the above configuration may be mounted to a lower portion of the front surface of the drum 30. If then, the motion space 72 formed in the ball balancer 70 may be partitioned by the motion members 71 and thus it is preferable that the ball balancer 70 is mounted to the drum in consideration of the partition members 71.

Specifically, the drum 30 includes the lifters 32 lifting and dropping the laundry and the laundry is typically positioned in space between the lifters 32 during the rotation of the drum 30 at the high rotation numbers. At this time, it is preferable that the ball balancer 70 is installed in consideration of the arrangement of the lifters 32 and the partition members 71, which will be described in detail in reference to a corresponding drawing.

Figure 6:
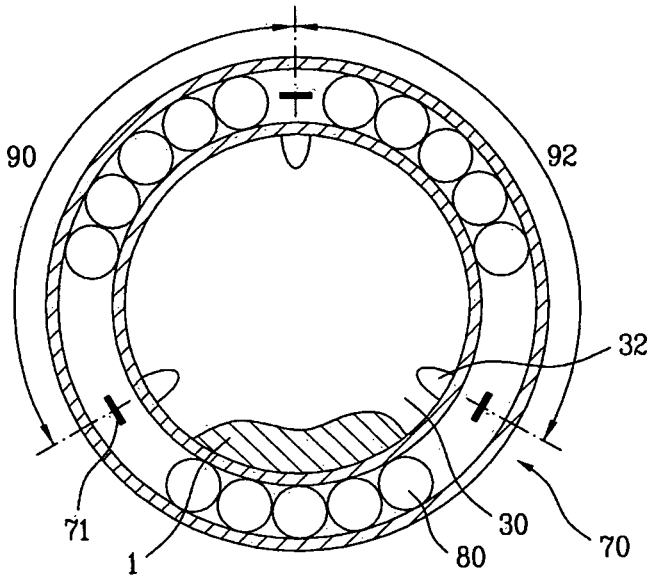
FIG. 6 is a diagram schematically illustrating an inner configuration of a laundry apparatus having different components from the laundry apparatus shown in FIG. 1.

FIG. 6 is a diagram schematically illustrating a laundry apparatus including the ball balancer 70 mounted to the drum 30 only to accelerate the noise and vibration.

According to the laundry apparatus shown in FIG. 6, in case of installing the ball balancer 70, the partition members 71 provided in the ball balancer 70 accord with the lifters 32 provided in the drum 30 in a semi-circumferential direction. If the ball balancer 70 is installed as mentioned above, the ball members 80 inside the ball balancer 70 are collected opposite to the laundry positioned in the space between lower lifters 32 of the drum during the rotation of the drum 30 at the high rotation number. All of the ball members 80 arranged in the adjacent partitioned spaces 90 and 92 are moved to the portion opposite to the laundry and collected with respect to the uppermost partition member 71 shown in FIG. 6. If all of the ball members 80 arranged in the two partitioned spaces 90 and 92 are collected with respect to the uppermost partition member 71, the drum 30 would be rotated eccentrically by the laundry distributed not uniformly. That is, the ball members 80 collected in one side of the ball balancer 70 would cause more noise and vibration during the rotation of the drum 30.

Because of that, the partition members 71 of the ball balancer 70 and the lifters 32 of the drum 30 are alternating in a semi-circumferential direction, respectively, according to the exemplary embodiment of the laundry apparatus.

Figure 5:
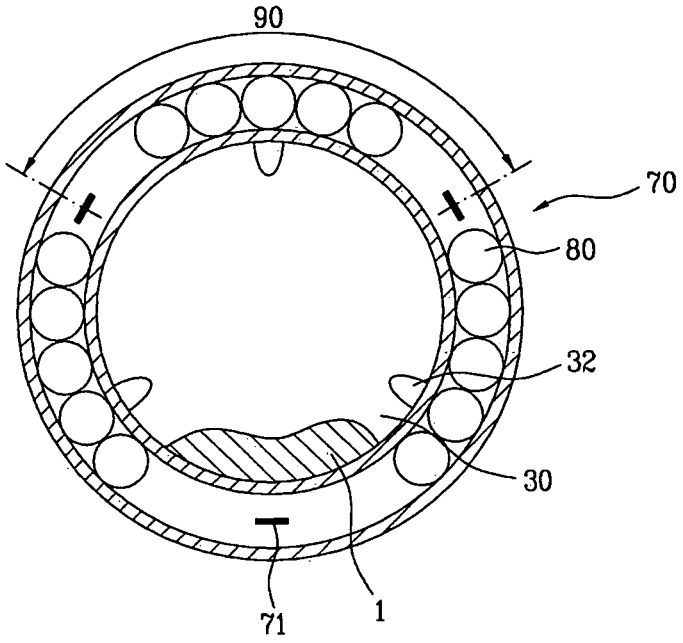
FIG. 5 is a diagram schematically illustrating an inner configuration of the laundry apparatus shown in FIG. 1.

In reference to FIG. 5, the partition members 71 provided in the ball balancer 70 alternate with the lifters 32 of the drum 30, respectively. It is preferable that the ball balancer 70 is mounted to the drum 30, with each partition member 71 of the ball balancer 70 positioned at a center between each two lifters 32 in a semi-circumferential direction.

If the ball balancer 70 is mounted to the drum 30 as mentioned above, the noise and vibration may not be accelerated by the ball members 80 collected in one side of the ball balancer 70. As shown in FIG. 5, in case the laundry 1 is collected in a lower portion of the drum 30 during the rotation of the drum 30 at the high rotation number, the ball members 80 of the ball balancer 70 are collected opposite to the laundry 1. At this time, each partition member 71 is positioned between each two adjacent two lifters 32. As a result, only the ball members 80 arranged in the partitioned motion space 90 are moved direct opposite to the laundry 1. here, the ball members 80 arranged in the partitioned spaces adjacent to the space 90 opposite to the laundry may be moved to a portion closest to the opposite space, that is, toward the partition members 71 opposite to the laundry although not moved to the space direct opposite to the laundry.

As a result, the partition members 71 of the ball balancer 70 are alternating with the lifters 32 of the drum 30, respectively, the entire ball members 80 inside the ball balancer 70 are not collected in the one side and thus the noise and vibration may not be accelerated.

As mentioned above, the ball balancer is controlled and the noise and vibration of the laundry apparatus may be reduced noticeably.

Especially, in case of the spinning cycle in that the drum is rotated at the high rotation number, the noise and vibration may be reduced noticeably.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry apparatus comprising:

a drum receiving laundry therein, the drum comprising a plurality of lifters extending inward, the lifters lifting and dropping the laundry during a rotation of the drum;

a circular housing provided in an outer surface of the drum, the circular housing comprising motion space formed therein;

at least two partition members spaced apart a predetermined distance along a direction of circumference of the motion space of the housing, the at least two partition members alternating with the plurality of the lifters in a semi-circumferential direction, respectively, and partitioning the motion space into at least two spaces; and at least two ball members movable inside the each of the partitioned spaces of the motion space, wherein each partition member is spaced apart a predetermined distance from both an inner surface and an outer surface of the circular housing so that the viscous fluid is able to pass the partition members and the ball members are unable to pass the partition members, the motion space of the housing is between the inner and outer surfaces of the circular housing, wherein each partition member is positioned at center between each two lifters in a semi-circumferential direction.

2. The laundry apparatus of claim 1, further comprising:

viscous fluid filled in the motion space.

3. The laundry apparatus of claim 2, wherein the viscous fluid is able to pass the partition members are unable to pass the partition members.

4. The laundry apparatus of claim 3, wherein at least one of the partition members comprises a rib or boss.

5. The laundry apparatus of claim 4, wherein the numbers of the ball members distributed in each partitioned space are equal.

6. A laundry apparatus comprising:

a drum receiving laundry therein, the drum comprising a plurality of lifters extending inward, the lifters lifting and dropping the laundry during a rotation of the drum;

a circular housing provided in an outer surface of the drum, the circular housing comprising motion space formed therein;

at least two partition members spaced apart a predetermined distance along a direction of circumference of the motion space of the housing, the at least two partition members alternating with the plurality of the lifters in a semi-circumferential direction, respectively, and the partition members partitioning the motion space into at least two spaces;

at least two ball members movable within each of the partitioned spaces of the motion space; and viscous fluid filled in the motion space, wherein each partition member is positioned at center between each two lifters in a semi-circumferential direction.

7. The laundry apparatus of claim 6, wherein at least one of the partition members comprises a rib or boss.

8. The laundry apparatus of claim 6, wherein the numbers of the ball members distributed in each partitioned space of the motions space are equal.

* * * * *